US005123602A

United States Patent [19]

Skalleberg et al.

[11] Patent Number: 5,123,602

[45] Date of Patent: Jun. 23, 1992

[54] MACHINE FOR WINDING CABLES OR THE LIKE ON OR OFF A DRUM

[75] Inventors: Oystein Skalleberg, Vallingby; Lars Tersmeden, Jarfalla, both of Sweden

[73] Assignee: Skaltek AB, Kungsangen, Sweden

[21] Appl. No.: 602,138

[22] Filed: Oct. 23, 1990

[30] Foreign Application Priority Data

Oct. 31, 1989 [SE] Sweden ..... 8903648

[51] Int. Cl.[5] ..... B65H 75/30

[52] U.S. Cl. ..... 242/54 R; 242/79

[58] Field of Search ..... 242/54 R, 58.6, 79, 242/86.5 R, 86.52

[56] References Cited

U.S. PATENT DOCUMENTS

| | | | |
|---|---|---|---|
| 3,625,445 | 12/1971 | Hall | 242/86.5 R X |
| 3,687,385 | 8/1972 | Skalleberg | 242/54 R |
| 3,948,462 | 4/1976 | Maillefer | 242/158 R |
| 4,098,468 | 7/1978 | Skallberg | 242/54 R |
| 4,209,140 | 6/1980 | Seibert | 242/79 |
| 4,575,016 | 3/1986 | Pali | 242/79 X |
| 4,679,743 | 7/1987 | Dallmaier | 242/54 R |
| 4,718,817 | 1/1988 | Maillefer | 414/744 R |
| 4,781,335 | 11/1988 | Compagnon | 242/54 R |

FOREIGN PATENT DOCUMENTS

| | | |
|---|---|---|
| 1961378 | 6/1970 | Fed. Rep. of Germany . |
| 1514439 | 6/1978 | United Kingdom . |

*Primary Examiner*—John M. Jillions
*Attorney, Agent, or Firm*—Nixon & Vanderhye

[57] ABSTRACT

A drive for machines for winding cables or similar elongate objects on and off a flanged drum having a center hole includes at least two columns and a pair of support elements that are supported by a respective one of the columns for vertical powered movements therealong. The support elements are joined to one another by a transverse telescopically extensible crossbeam. A pair of bearing bosses are each carried by respective ones of the support elements and are adapted to being inserted into the center hole of the cable drum such that, upon movement of the support elements (and hence the bearing bosses), the drum will be raised above a foundation upon which it normally rests. At least one resilient, yieldable wheel is pivotally connected to one terminal end of a link so as to be capable of resting against the flange. The link is, in turn pivotally coupled to one of the support elements. A guy structure extends between and is operatively connected to the other terminal end of the link and a stationary position on one of the columns. The link and the guy structure have predetermined lengths such that, when the bearing bosses are introduced into the center hole of the cable drum while it rests on the foundation, the wheel is set a defined distance from the drum flange. Thus, when the drum is raised, the flange will be pressed against the wheel such that preselected driven pressure is exerted thereby against the drum flange. The drum is thus reliably rotated upon rotation of the wheel so as to wind cable on and off the drum.

2 Claims, 4 Drawing Sheets

MACHINE FOR WINDING CABLES OR THE LIKE ON OR OFF A DRUM

TECHNICAL FIELD OF THE INVENTION

The present invention relates to a drive for machines for winding cables or the like on or off a drum, and particularly machines of the portal type, i.e., such as those described in Swedish Patent 399864 (7603752-2) which corresponds, for example, to the U.S. Pat. No. 4,098,468. This kind of machine essentially comprises two columns, each column carrying a support element that can be moved vertically along corresponding columns by means of a power unit.

The two support elements should suitably be joined to each other by a transverse telescopically extensible crossbeam such that the two support elements and the crossbeam can be moved vertically as one unit. Each support element carries a bearing boss intended for carrying a cable drum, or the like, that can be moved in approximately the vertical direction in order to raise the cable drum so as to provide clearance between the drum and the foundation.

BACKGROUND OF THE INVENTION

In machines of the above-mentioned kind, the cable drum is usually rotated by a drive attached to the support and provided with a plug that is inserted into a hole in the flange of the drum. The hole is disposed concentrically relative to the center hole of the drum. These drives usually must be especially made for different drum types and drum sizes, and therefore must be exchanged or adjusted manually when the drum size is changed. Furthermore, it often is difficult to guide the driver plug into the designated hole in the drum. In general, there is some amount of play between the driver plug and the drum hole, and there is a risk of the plug being inserted between spokes, which may be present, rather than in the hole intended for this purpose. This may cause the cable to jolt and thus cause damage to the cable and driver, which can destroy it when the machine is started. The impact stresses thus propagate from the driver to the power unit that rotates the driver. As a result, the drive unit is subjected to undesirable stresses. Because of its asymmetrical construction, the driver also causes an imbalance that subjects the bearings carrying the weight of the drum to excessive stresses. This imbalance is difficult to control. Furthermore, the driver requires a comparatively large motive force in order to attain a specifically defined tensile force in the cable due to the leverage conditions that are determined by the ratio of the length of the driver to the size of the drum. When the drum size is changed a relatively expensive gear box is required in order to adapt the number of revolutions to the size of the drum.

A solution to the problem has been attempted by driving the flange by means of a wheel resting against the flange and driven by means of a driving motor. This eliminates many of the problems encountered when using a driver plug and allows the design of an altogether smaller drive, since the need for installing a bulky motor with gear box together with the bearing bosses is eliminated. This allows production lines to be located somewhat closer to each other, which also means smaller storage halls are needed. This can be of great importance economically.

When driving the flange, the number of revolutions of the drum increases for a smaller drum, allowing a fixed exchange ratio between the motor and the drive wheel, and thereby eliminating the need to exchange the location of the gears when the drum size is changed. The drive wheel in these earlier designs moved against the drum flange by means of an adjustment screw, a hydraulic cylinder or pneumatic cylinder. All these designs are relatively costly and complicated and have not therefore been used extensively. For automatic adjustment relative to the flange of the drum when exchanging the drum, particularly when the drum size is changed, relatively complex sensing and guiding devices are required, primarily with a view to obtaining a relatively precise contact pressure between the drum and the drive wheel. In designs using pneumatic cylinders this problem is avoided to some extent since the contact pressure can be readily controlled by means of the air pressure in the cylinder. However, a problem arises due to the relatively short action range of pneumatic cylinders. In some cases another problem is caused by the tangential force between the drive wheel which counteracts the contact pressure from the cylinder and cancels it at least partially since the wheel is not mechanically locked, but yields to the compressed air.

SUMMARY OF THE INVENTION

It is an object of the present invention to provide a design for a drum of a machine of the kind mentioned at the outset by making a very simple adaptation to drums of varying sizes and which avoids the problems encountered in earlier designs for driving drums by means a wheel resting against the flange.

According to the present invention this object is achieved by a drum that can be rotated, for winding cables on or off it, by at least one wheel rotatable by means of a drive element. The wheel rests against the flange of the drum and drives the same. The wheel moreover is mounted in a bearing at one end of the first link which, approximately at its center, is pivoted to one of the support elements, and at its other end is pivoted and rigidly fixed to one end of a guy attachment. The whose other end of the first link is again rigidly fastened with a pivot, preferably to one of the columns. The length of the link and of the guy is selected such that when the bearing bosses are inserted in the center holes of the cable drum, but at a time when the drum has not yet been raised thereby, the driving wheel is spaced at a specific (but not too great) distance from the drum flange such that the flange of the drum is pressed against the yielding wheel when the drum is raised a predetermined distance by means of the bearing bosses.

In this manner, the position of the drive wheel is automatically adapted relative to the flange when the elements are vertically adjusted in order to adapt the height of the bearing bosses to the center hole in the cable drum irrespective of the drum size. No special sensor or guiding devices are required to achieve this benefit. By utilizing the limited air flow of the bearing bosses in order to raise the drum by exactly the amount required for clearing the foundation, a defined movement against the elastic force of the elastic drive wheel is obtained. This means that a clearly defined contact force will be obtained for a given drum size. The present invention thus solves, in a particularly simple manner, the problems encountered in solutions heretofore with a wheel driving the flange of the drum. Because of the simplicity of the design, the present invention also saves costs in a particularly favorable manner.

DETAILED DESCRIPTION OF A PREFERRED EMBODIMENT OF THE PRESENT INVENTION

Figure 1:
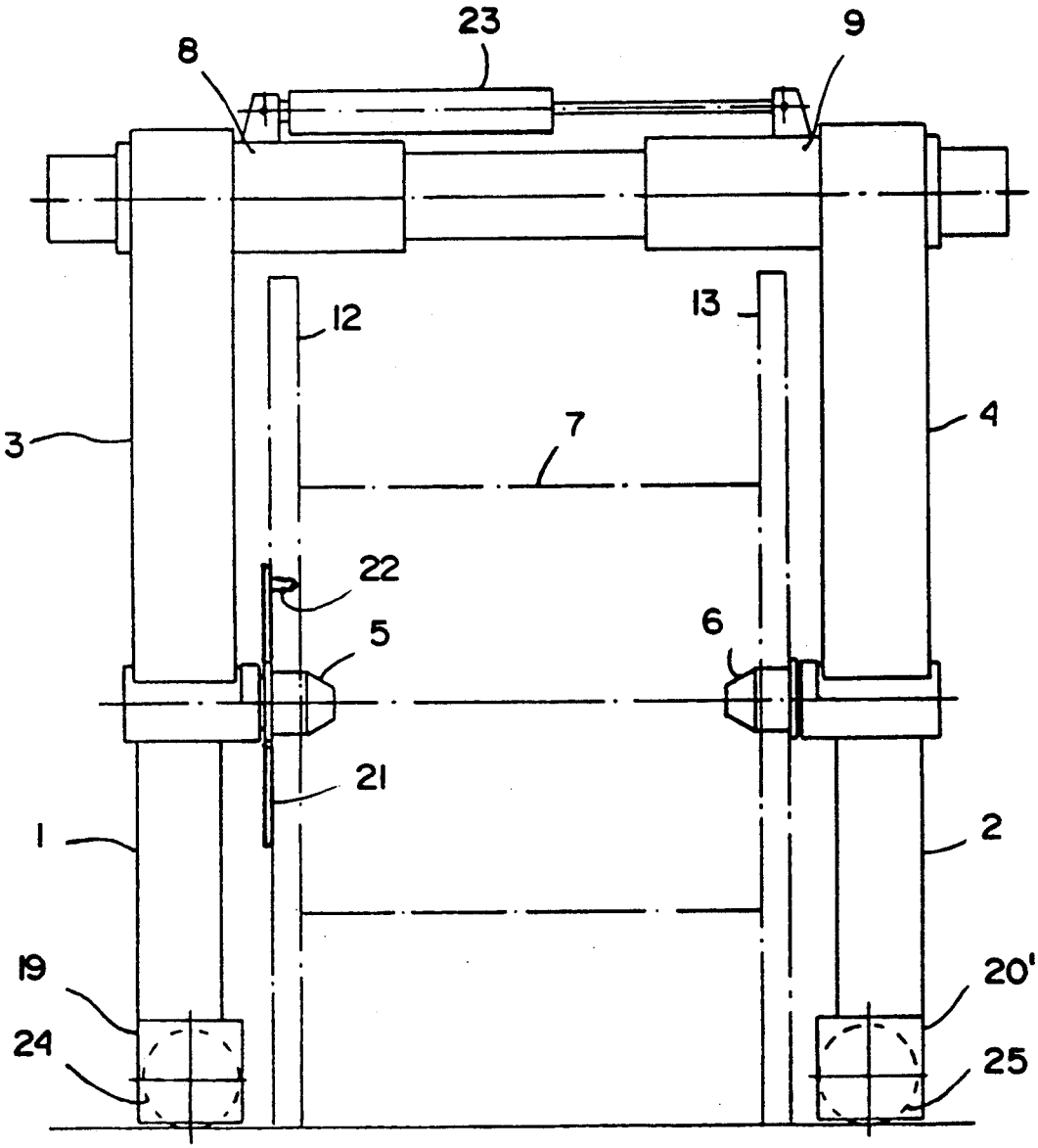
Fig. 1 (PRIOR ART)
FIG. 1, shows a front view of a device for winding cable on or off a conventional cable drum provided with a driver.

A machine for winding cable on and off cable drums of the conventional type such as that shown in Swedish Patent No. 399864 is shown in FIG. 1. The machine comprises two columns 1, 2, each column being disposed on its corresponding foot beam 19, 20. On top of each column is disposed a support element 3, 4 movable in the vertical direction, each support element carrying a bearing boss 5, 6 intended for insertion into the center hole of the cable drum. On one of the bearing bosses 5 is disposed a driver 21 provided with a driver plug 22. The driver plug 22 is intended for insertion into a center hole in the drum flange.

A drum 7 with flanges 12, 13 is indicated in the Figure by dot-dash lines. The driver 21 is rotated by a drive unit (not shown), comprising a motor and a gear box in a conventional manner. The bearing bosses 5, 6 can be moved to a limited extent, for example, 3 to 5 cm, i.e., vertically relative to the support elements 3, 4 in order to thus raise the drum disposed on the bearing bosses 5, 6 such that the foundation is clear. The support elements are connected to each other by means of a transverse, telescopically extensible support beam consisting of two parts 8, 9. The support beam can be lengthened and shortened by means of a hydraulic cylinder 23. Each support foot 19, 20 is fitted with a wheel 24, 25 allowing the columns 1, 2, together with the support elements 3, 4, to be moved on the foundation towards each other or away from each other depending on whether the crossbeam 8, 9 is shortened or lengthened by means of the hydraulic cylinder 23.

The drums are transported to the machine by conventional transport means, for example, in the present case by a loop-steered transfer truck. Prior to the arrival of the drum 7 at the winding-on machine, the height of the drum flanges 12, 13 is determined in the usual manner (not shown) and a signal is transmitted to the machine, which moves the support elements 3, 4 in the vertical direction such that the bearing bosses 5, 6 will be at the same height as the center holes in the drum. Alternatively, a signal relating to the drum size is transmitted to the machine from a computer which, as part of the control of an entire process, has selected the drum that is correct instantaneously. When the drum has been placed between the columns 1, 2, they are guided towards each other by the hydraulic cylinder 23 such that the bearing bosses 5, 6 are guided into the center hole of the drum. Thereafter the bearing bosses 5, 6 are raised relative to the support member by exactly the amount required by the drum flanges to clear the foundation, i.e., in the present case the loop-guided truck (not shown); whereupon the drum 7 can be rotated by the driver 21.

Figure 2:
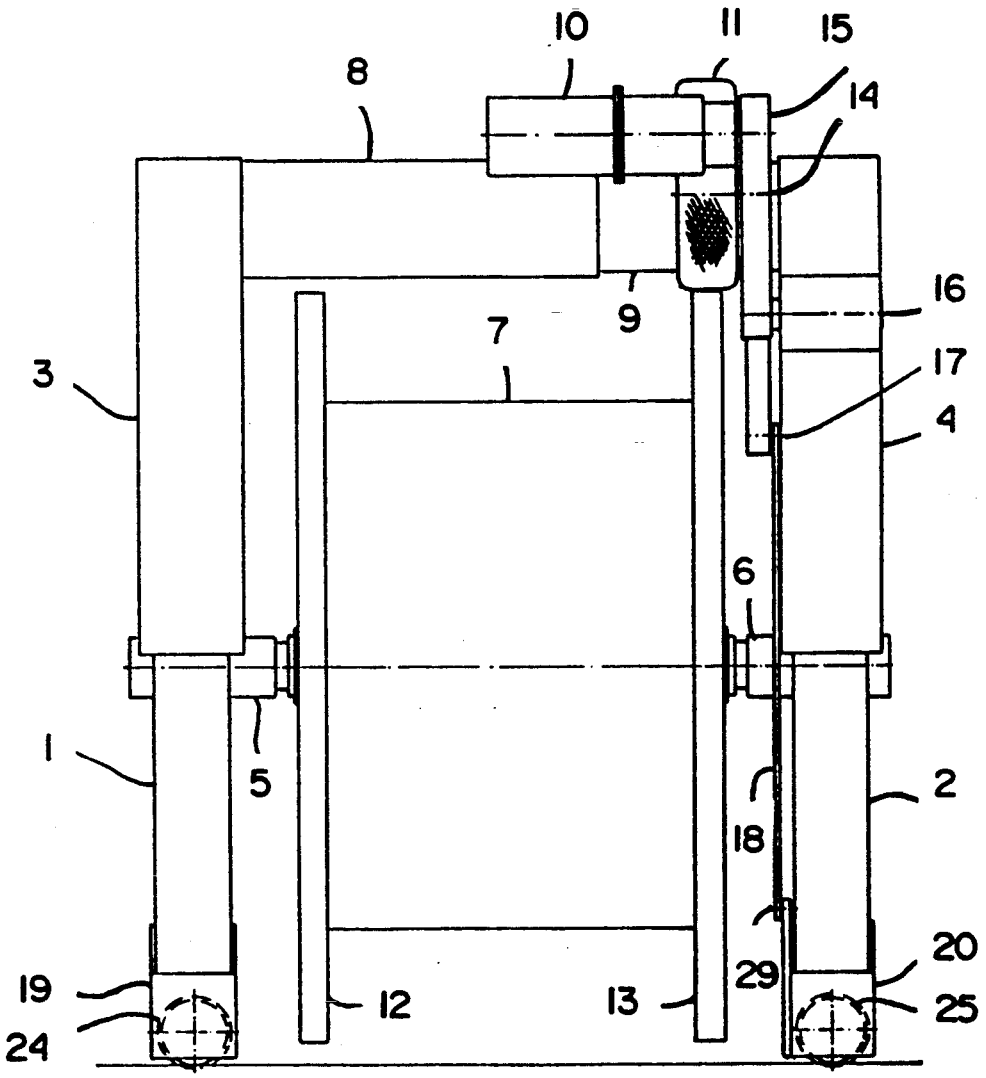
FIG. 2, shows a similar device in front view, but provided with a drive according to the present invention.
Figure 3:
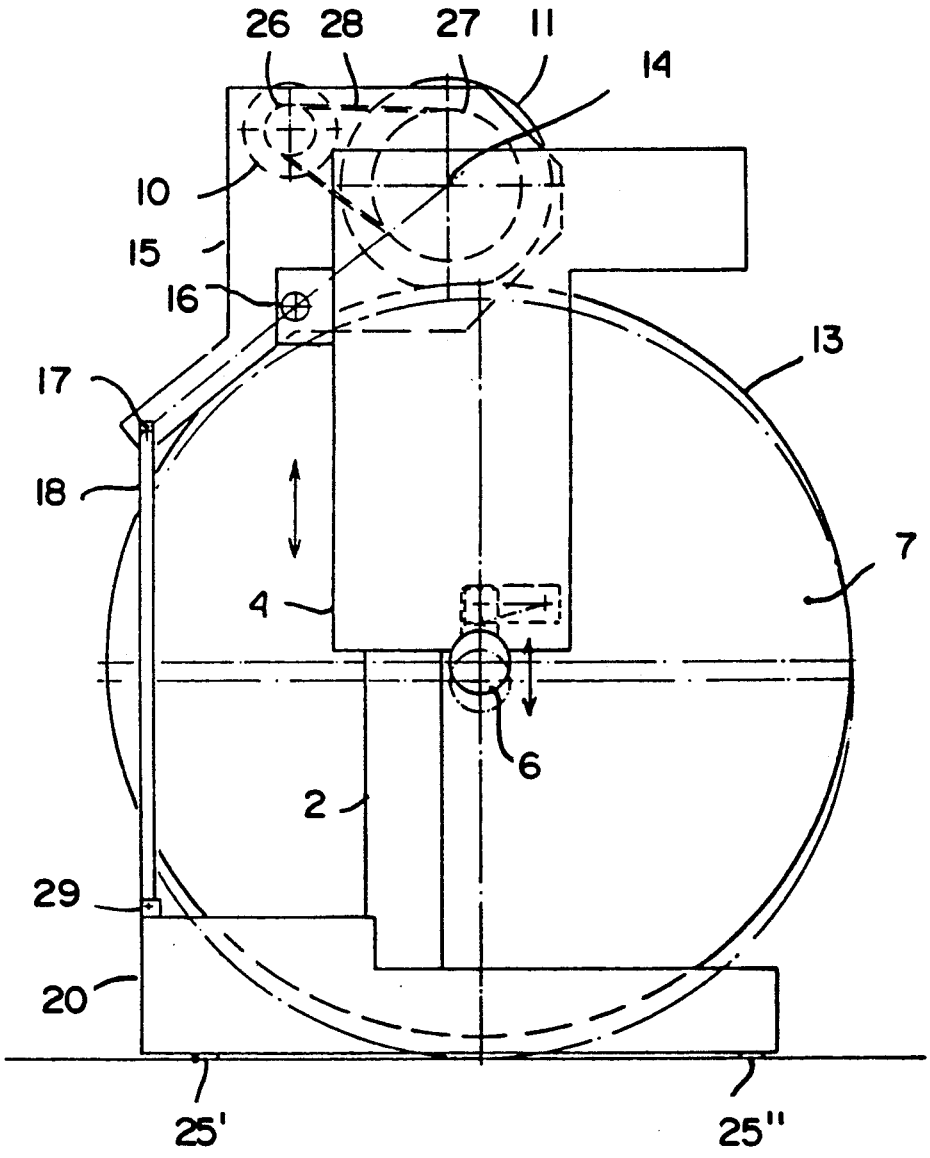
FIG. 3, shows the device of FIG. 2 in lateral view with the use of a larger cable drum.
Figure 4:
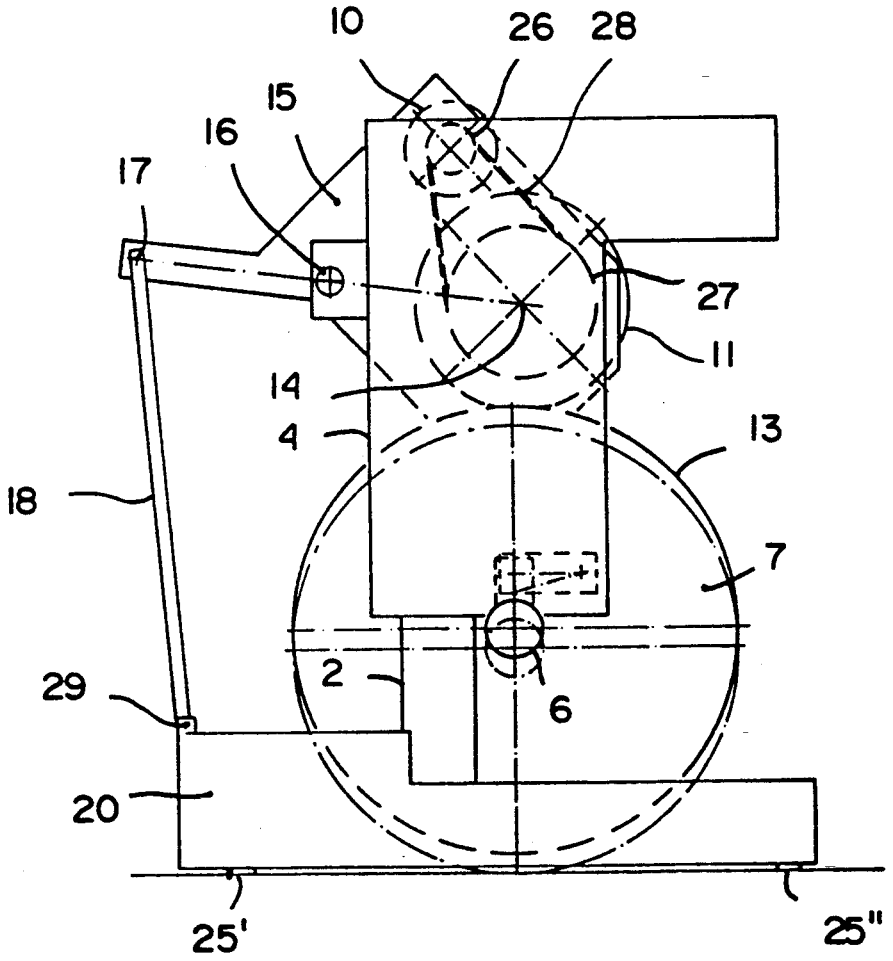
FIG. 4, shows the device according to FIG. 3 likewise in lateral view but showing the integral parts when using a comparatively small cable drum.

From FIGS. 2 to 4 it is evident how the driver 21, together with the drive unit (not shown), has been replaced by a wheel that drives against the flange of the drum in accordance with the present invention. In the present case the wheel consists of an ordinary car tire on an ordinary rim which is mounted on an ordinary hub part 14 supported on a bearing at one end of a link 15. A drive motor 10 that drives the hub part 14 via two cog wheels 26, 27 and a cog belt 28 is disposed on the link 15. At the center of its total extension the link 15 is secured to the support element 4 by means of a pivot 16. The other end of the link 15 is secured by means of the pivot 17 to one end of a guy attachment 18, whose other end is secured to the foot beam 20 by means of a pivot 29. The guy attachment 18 thus is immovably pivoted on the foot beam 20. In this embodiment the yielding properties of the drive wheel 11 are due to the resilience of the tire.

The manner in which the drive functions is shown in detail in the FIGS. 3 and 4. FIG. 3 illustrates the conditions under which a cable drum having the maximum size which the machine is intended for is mounted. The support elements then are in their top position and, as is evident from FIG. 3, the drive wheel 11 also is in its highest position. Since the two parts of the link 15 are equally long on both the sides of the pivot 16, the hub 14 that supports the wheel 11 at one end of the link 15 will move vertically twice as much as the pivot 16 on the support element 4 when the element is displaced vertically because the pivot 17 on the guy attachment 18 thus is substantially idle. This means that when the support element 4 is moved to a certain extent to adapt to the center hole of the drum 7, i.e., to adapt to the radius of the drum 7, the drive wheel 11 will move twice this amount, i.e., it will adapt to the diameter of the drum 7 and thus also to the flange.

In FIG. 3 the position of the drum on the foundation is indicated by dot-dash lines. The length of both the link 15 and the guy 18 have been so selected that the periphery of the wheel 11 is at a short interval of 1 or 2 cm above the upper periphery of the drum. As described herein, before, when the drum is raised with the aid of the bearing bosses 5, 6 by the predetermined amount of, e.g., 5 cm, in order clear the foundation, the flange 13 is then pressed into the tire by a defined amount of approximately 3 cm. If the tire has the standard air pressure for automobile tires, for example, 2 kg per $cm^2$, this indicates that the contact pressure between the tire of the wheel 11 and the flanges 13 is well defined and that no additional measures are required for monitoring a correct contact pressure.

As is evident from FIG. 4, when a drum having a smaller flange diameter and when consequently the support elements 3, 4 must be lowered in order to adapt the height of the bearing bosses 5, 6 to the level of the center hole in the drum, the pivot point 16 is lowered by the same amount as the bearing bosses 5, 6 while the hub 14 will be lowered twice that amount. That is, the wheel 11 will substantially adapt itself to the reduced diameter such that the wheel 11 remains in a position of approximately 1 cm above the flange. When the bearing bosses 5, 6 have entered the drum 7 and the drum is raised by said bearing bosses, the flange is then again pressed into the tire on the wheel 11 by a defined amount. This in turn results in a definite contact pressure between the wheel 11 and the flange 13. It must be emphasized that the contact pressure is somewhat lower for the smallest dimensions of the drum 7 since in its new position the wheel 11 is at a somewhat greater distance from the flange of the drum due to the fact that the hub 14 of the wheel 11 moves along an arc. This is desirable since a smaller drum requires a smaller driving force.

As is evident from the Figures, a suitable distance between the points 17 and 14, can be equal to the diameter of the flange of the large drum for which the drive is intended, i.e., when the pivot point 16 is approximately at the level of the upper edge of the flange. However, the length of the link 15 can vary within fairly large limits, primarily depending on the external dimensions of the largest and smallest drums for which the machine is intended. It is also conceivable that it would be suitable to so design the link 15 that the pivot point 16 would not be exactly halfway between the pivot point 17 and the hub 14 since it can be assumed that for example, in order to further reduce the contact pressure between wheel and flange for smaller drum dimensions, the wheel would move less than twice the amount of movement of the support elements 3, 4.

The elasticity and the resilience of the wheel 11 can obviously be obtained by various means other than by using a standard automobile tire although this is a very simple solution that also is very favorable from a cost point of view. Instead, the axle of the wheel can be provided with a flexible suspension allowing the wheel to be pushed somewhat upwards against the spring tension of the suspension. Even in this case a defined displacement of the wheel will result in a defined contact pressure against the flange.

In this connection it must be pointed out that the link 15 is completely mechanically locked by means of the guy 18. This means that the inconvenience of a reduced contact force caused by the tangential force at the periphery of the wheel when rotating the drum cannot act on the contact pressure between wheel and flange.

In the above-described embodiment only one wheel is used to drive a flange. However, it is obviously possible to double the drive and thus install a link with one wheel on each of the support elements 3, 4 and to drive the two flanges of the drum in this manner.

Furthermore, the link 15 and the guy 18 can also be designed such that their length can be adjusted to some extent for adaptation to various contact pressures and drum dimensions.

It is evident from the above description that the crossbeam is needed for the present invention in order to function, but that the columns could be disposed closer together or further apart in any other suitable manner, for example, by being mounted on carriages that can be moved towards and away from each other.

Even though the present invention in its above-described embodiment primarily relates to cables it is also applicable to other similar oblong objects, as for example, continuous plastic tubes, etc.

Finally it must be pointed out that although the present invention has been described primarily in connection with a more or less automatic handling of drums, it can also be applied with advantage to a more or less manual operation of cable drums, for example, by means of a fork lift.

We claim:

1. A drive for machines for winding cables or similar elongate objects on and off a flanged drum having a center hole, said drive comprising:

at least two columns;

a pair of support elements, each said column supporting a respective support element that can be moved for vertical movements along said column, a first power unit operatively coupled to said support elements for moving the same along said columns;

a pair of bearing bosses each of which is carried by a respective one of said support elements for insertion into the center hole of the cable drum;

a second power unit operatively coupled to said bearing bosses to move the bearing bosses substantially vertically so as to, in turn, raise the cable drum so that the drum is spaced from a foundation upon which it rests;

a transverse telescopically extensible crossbeam which joins said support elements one to another such that said support elements and said crossbeam can be moved as one unit in a vertical direction;

at least one resilient, yieldable wheel which is adapted to rest against a flange of the cable drum in driving engagement therewith;

a link having one and another opposed terminal ends, one of said terminal ends rotatably supporting said wheel, said link being pivotally coupled to one of the support elements;

a guy structure having opposed connection ends and extending between one of said columns and said another terminal end of said link, wherein said guy structure at one of said connection ends thereof is rigidly coupled to said another opposed terminal end of said link, and wherein said guy structure at the other of said connection ends thereof is fastened at a stationary position to one of said columns; and a drive unit coupled operatively to the wheel for rotating the wheel in driven engagement with the flange of the drum so as to cause the drum to rotate and thereby wind cable thereon or therefrom; wherein said link and said guy structure have predetermined lengths such that when the bearing bosses are introduced into the center hole of the cable drum and the drum has not yet been raised thereby, the yieldable wheel is set at a defined distance from the drum flange, and wherein said drum flange is pressed against the yieldable wheel in response to the flange of the drum being raised to a predetermined extent by the bearing bosses so that the yieldable wheel exerts a predetermined pressure upon the drum flange.

2. A drive as in claim 1, wherein the wheel includes a rim, and an inflated rubber wheel mounted on said rim.

* * * * *